US008807000B2

(12) United States Patent
Norberg et al.

(10) Patent No.: US 8,807,000 B2
(45) Date of Patent: Aug. 19, 2014

(54) CUTTING UNIT IN AN ARRANGEMENT FOR CUTTING AND REMOVAL OF WIRES FROM BALES AND A DEVICE COMPRISING SAID CUTTING UNIT

(75) Inventors: Mats Norberg, Kovland (SE); Stefan Nordhalling, Ankarsvik (SE); Goran Strand, Matfors (SE); Martin Jakobsson, Liden (SE)

(73) Assignee: Valmet Technologies Inc., Espoo (FI)

( * ) Notice: Subject to any disclaimer, the term of this patent is extended or adjusted under 35 U.S.C. 154(b) by 909 days.

(21) Appl. No.: 13/000,734

(22) PCT Filed: Jun. 18, 2009

(86) PCT No.: PCT/SE2009/050766

§ 371 (c)(1),
(2), (4) Date: Dec. 22, 2010

(87) PCT Pub. No.: WO2010/002335

PCT Pub. Date: Jan. 7, 2010

(65) Prior Publication Data

US 2011/0100174 A1 May 5, 2011

(30) Foreign Application Priority Data

Jul. 4, 2008 (SE) ..... 0801573

(51) Int. Cl.

| | |
|---|---|
| ***B26D 7/18*** | (2006.01) |
| ***B26D 1/00*** | (2006.01) |
| ***B26D 7/27*** | (2006.01) |
| ***B65B 69/00*** | (2006.01) |

(52) U.S. Cl.

CPC ..... *B65B 69/0025* (2013.01)

USPC ..... 83/679; 83/23; 83/154; 83/360

(58) Field of Classification Search

CPC ... B26B 69/0025; B65B 57/08; Y10S 83/909; B26F 3/02; B21F 33/04; A01F 15/141; A01F 12/14

USPC ..... 83/13, 909, 78, 23, 679, 360, 154, 155, 83/155.1; 29/564.3, 426.4, 426.3, 566.1, 29/566; 700/259; 104/102

See application file for complete search history.

(56) References Cited

U.S. PATENT DOCUMENTS

| | | | | |
|---|---|---|---|---|
| 1,243,353 | A * | 10/1917 | Snedeker | 140/92.7 |
| 3,513,522 | A | 5/1970 | Thomson | |
| 4,261,394 | A * | 4/1981 | Sterel | 139/439 |

(Continued)

FOREIGN PATENT DOCUMENTS

| | | |
|---|---|---|
| SE | WO9213768 | 8/1992 |

*Primary Examiner* — Ghassem Alie

(74) *Attorney, Agent, or Firm* — Rolf Fasth; Fasth Law Offices

(57) ABSTRACT

The device is for cutting and removing wires from bales, such as pulp bales, paper bales and the like. The device has at least one cutting unit that has a cutting tool for cutting off a wire that is arranged around a bale, and at least one winding unit that has a winding tool for unwinding the cut wire from the bale. The cutting tool has an outer cutter and an inner cutter which are coaxially arranged and rotatable with respect to each other. Each cutter has a cutting edge which are arranged to be moved towards each other when the cutters are rotated towards each other in a certain direction, in order to cut off objects, preferably bale wires, between them.

2 Claims, 4 Drawing Sheets

(56) References Cited

U.S. PATENT DOCUMENTS

| | | | | |
|---|---|---|---|---|
| 4,261,395 | A | 4/1981 | Gronau | |
| 4,841,619 | A | 6/1989 | Theriault | |
| 4,850,087 | A | 7/1989 | Gronau | |
| 5,297,329 | A | 3/1994 | Santin | |
| 6,115,904 | A * | 9/2000 | Merrill et al. | 29/426.4 |
| 7,152,634 | B2 * | 12/2006 | Peters et al. | 140/102 |
| 8,160,748 | B2 * | 4/2012 | Pienta et al. | 700/259 |

* cited by examiner

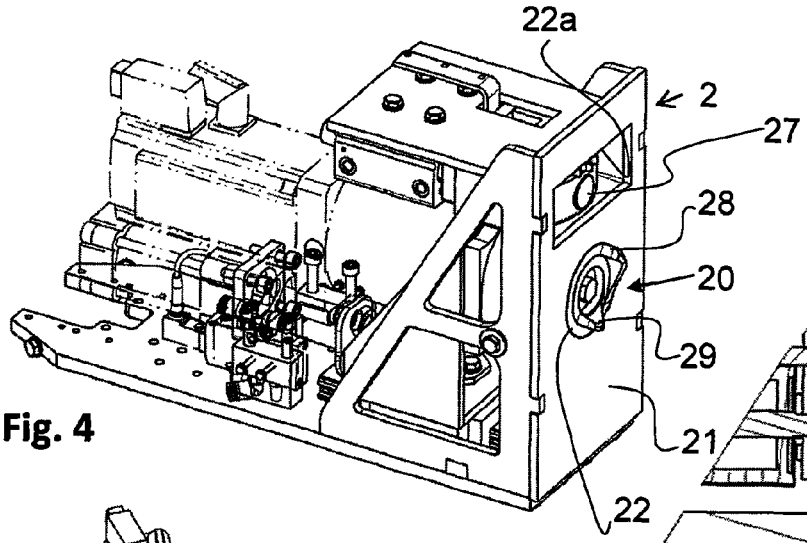
Fig. 4
Fig. 5
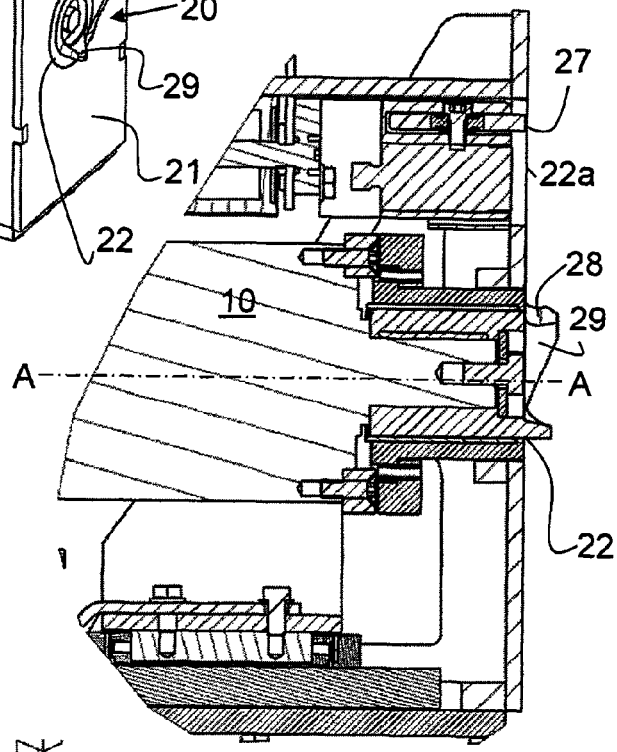
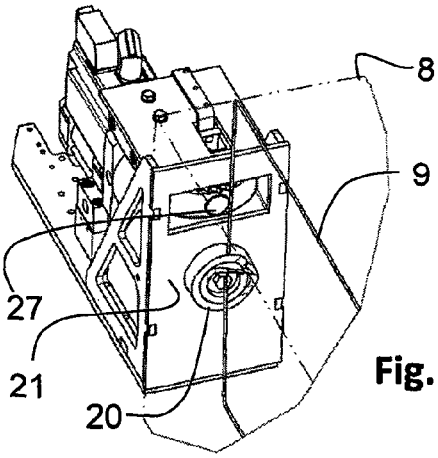
Fig. 6
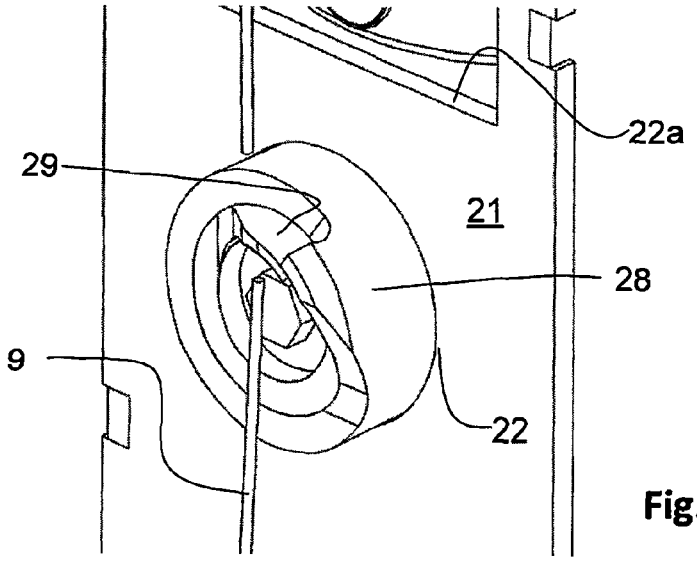
Fig. 7

CUTTING UNIT IN AN ARRANGEMENT FOR CUTTING AND REMOVAL OF WIRES FROM BALES AND A DEVICE COMPRISING SAID CUTTING UNIT

PRIOR APPLICATION

This application is a U.S. national phase application based on International Application No. PCT/SE2009/050766, filed 18 Jun. 2009 that claims priority from Swedish Patent Application No. 0801573-7, filed 4 Jul. 2008.

TECHNICAL FIELD

The present invention relates to a cutting unit in an arrangement for cutting and removal of wires from bales, such as pulp bales, paper bales and the like. The invention also relates to a device comprising said cutting unit.

BACKGROUND AND SUMMARY OF THE INVENTION

When pulp or paper in the form of bales is to be dissolved for the final production of paper, the wires that keep the bales together must be removed. This may be done manually or mechanically. It is especially important to make sure that no wire remains with the pulp since this could cause great damage to the equipment in the following process steps.

The mechanical removal is usually carried out as a two-step operation. At first, the wires are cut off by means of one or more cutting devices and then the cut wires are removed. The removal is normally carried out by means of winding devices, which grab one end of the wire, or the centre of the wire and then rotate such that the wires are wound onto the device.

One such device is known from the American patent document U.S. Pat. No. 4,850,087. This known device is equipped with gripping members for transferring the wires from the place of cutting to the place of winding. This, however, adds another step, which makes the operation sensitive to possible errors.

In WO 9213768, a device is described in which the cutting and the removal are combined in one single elongated arrangement having an inner element and a surrounding tubular element, both comprising an indented edge, whereby the two elements rotate in relation to each other such that the wire is cut off and caught between the two elements, after which the elements rotate together to wind the cut wire around the arrangement.

A problem with this device is that the arrangement does not always grip the wires correctly, or on the contrary, the wires get caught between the two parts such that the operation has to be interrupted to release the wires. Furthermore, the arrangement needs a fairly complicated driving mechanism in order to accomplish all the steps.

Another problem is that it risks fraying the entire side of the bale since the cutting is carried out over the whole side of the bale instead of being centred at the positions where the wire is actually located. This results in wastage, which is undesired since it requires cleaning of the working area as well as decreases the degree of capacity utilisation of the bale material.

An object of the invention is to provide an improved device for the cutting and removal of wires from bales, which is reliable and easy to implement and which solves the above mentioned problems.

The said objects are obtained by means of the device, as disclosed in the claims, for the cutting and removal of wires from bales, such as pulp bales, paper bales and the like, which device comprises at least one cutting unit having a cutting tool for cutting off a wire that is arranged around a bale, and at least one winding unit having a winding tool for the unwinding of the cut wire from the bale.

The cutting tool of the cutting unit comprises an outer cutter and an inner cutter, which are coaxially arranged and rotatable with respect to each other, whereby the cutters comprise a cutting edge each, which are arranged to be moved towards each other when the cutters are rotated towards each other in a certain direction, in order to cut off objects, preferably bale wires, between them.

The winding unit is used to unwind and thus remove the cut wire from the bale. Said unwinding and removal are achieved by winding the wire onto the winding tool of the winding unit.

Preferably, a turning tool or turning plate is arranged at the centre of a working location W, in which the bale is intended to be positioned when its wires are cut off and removed from it, whereby the cutting unit and the winding unit are positioned opposite each other, on one side each of the working location (W), and whereby the turning tool or turning plate is arranged to be able to turn the bale 90° to relocate it into a position in which wires placed crosswise with respect to the first wires may be cut off and unwound.

Preferably, there are also driving units arranged to move the cutting unit and the winding unit towards and from the centre of the working location, between a working position, in which they are to be positioned when the wires are to be cut off and unwound, and a resting position, in which they are to be positioned out of reach of the bale when it is turned.

Moreover, conveyor belts may be arranged to transport the bale into and out of the working location (W), respectively.

Further, the device may comprise two cutting units and two winding units that are positioned pairwise opposite each other, on one side each of the working location.

The invention also relates to the cutting unit as described above.

Preferably, the cutters of the cutting unit are rotatable about an axis, which is intended to extend perpendicularly with respect to the wire that is to be cut off.

Further, the cutting edges of the cutters extend axially along the axis in the continuation of the cutting tool to cut off objects that are located in the continuation of the cutting tool along the axis.

Preferably, the cutting unit has a flat front portion, which is arranged to face a working location at which the bale is to be positioned when its wires are cut off and removed from it.

The flat front portion may comprise a recess through which the cutting tool is arranged to be carried forth and back between a retracted position and a working position, whereby in the retracted position it is positioned behind the front portion, and whereby in the working position it protrudes through the front portion in order to carry out the cutting.

Further, a sensor may be arranged to localise the wire on the bale, whereby a driving device is also arranged to move the cutting unit along the working location, such that the cutting tool may be positioned in front of the wire to be cut off.

As a result of the above disclosed device and cutting unit, an efficient and reliable cutting of bale wires is achieved, which reduces the wastage of pulp in connection with cutting of the wires.

An additional advantage of the invention is that the driving of the different tools for winding and for cutting may be the same. The only thing that has to differ between the two devices is the head of the tool, where the cutting tool shall be provided with two opposite surfaces, of which at least one is sharp, while the winding tool is instead provided with a gripping appliance for picking up the wires.

BRIEF DESCRIPTION OF THE DRAWINGS

The invention, together with further objects and advantages thereof, are best understood with reference to the accompanying description and the enclosed drawings, of which:

FIG. 4 shows a cutting unit according to the invention in a perspective view;

FIG. 5 shows the cutting unit in FIG. 4 from the side and partly in cross-section;

FIG. 6 shows the cutting unit and a bale, which is shown in cross-section;

FIG. 7 shows the cutting tool of the cutting unit in a close-up view and partly in cross-section when it cuts off a wire from a bale;

DETAILED DESCRIPTION OF AN EMBODIMENT OF THE INVENTION

Figure 1:
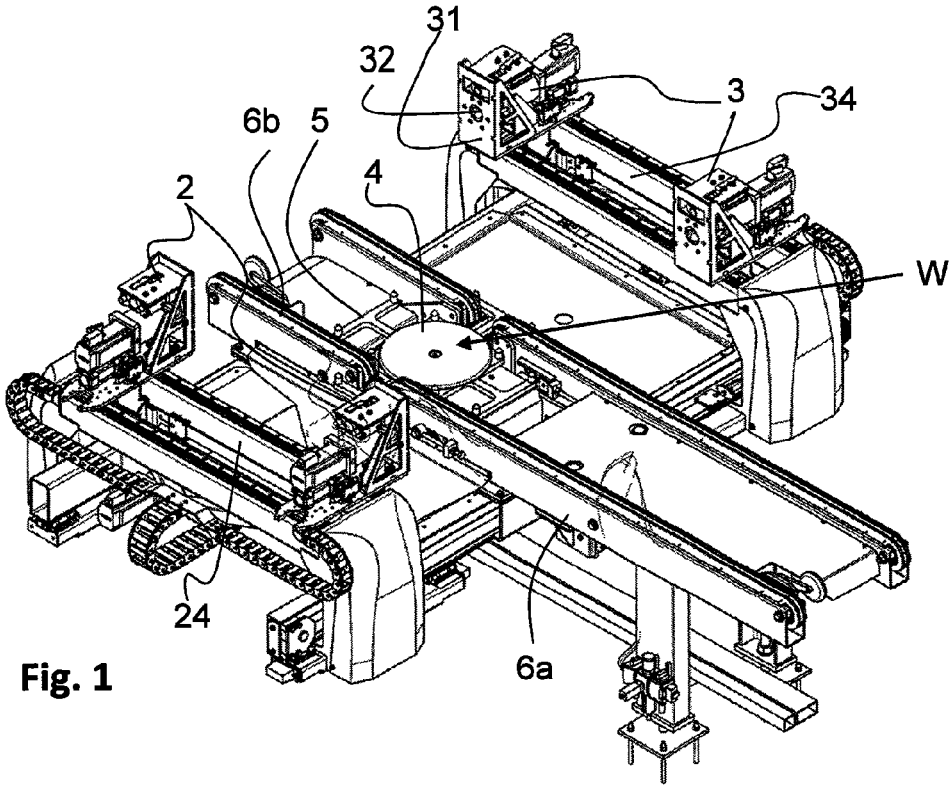
FIG. 1 shows a perspective view of the device for wire removal according to the invention.

In the drawings, similar or corresponding details are indicated by the same reference signs.

In the following, the general function of the device will be described with reference to the FIGS. 1-3 and thereafter the construction and the work of the different units will be described more in detail.

Figure 2:
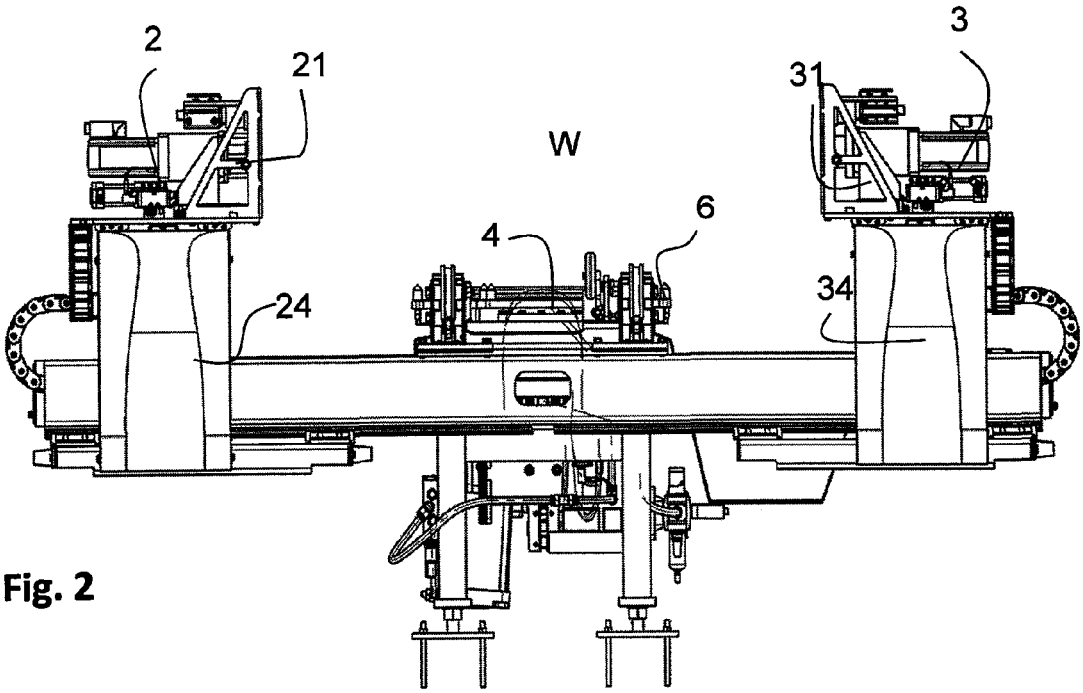
FIG. 2 shows the device for wire removal in FIG. 1 from the side.
Figure 3:
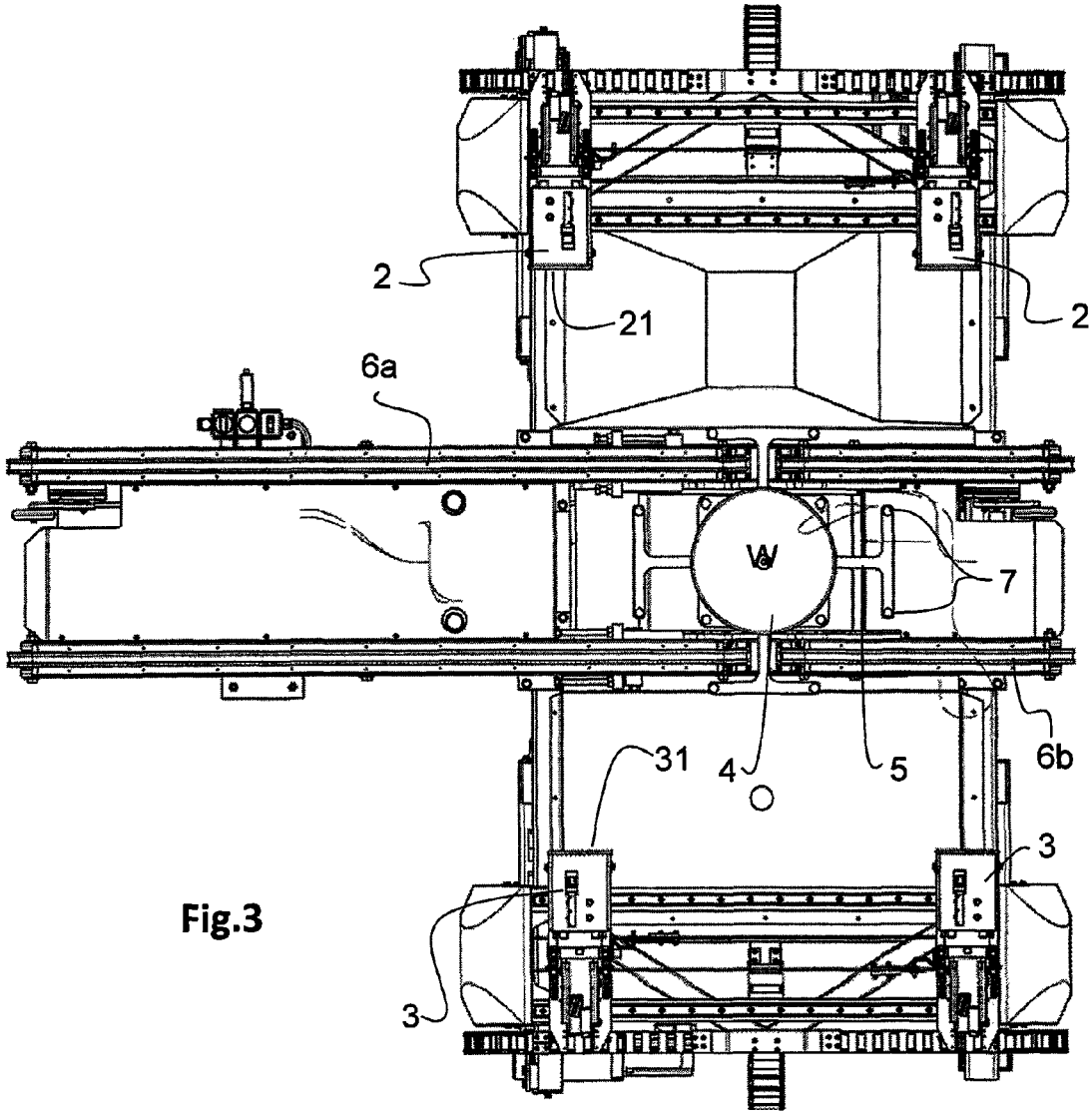
FIG. 3 shows the upper side of the device for wire removal in FIG. 1.
Figure 8:
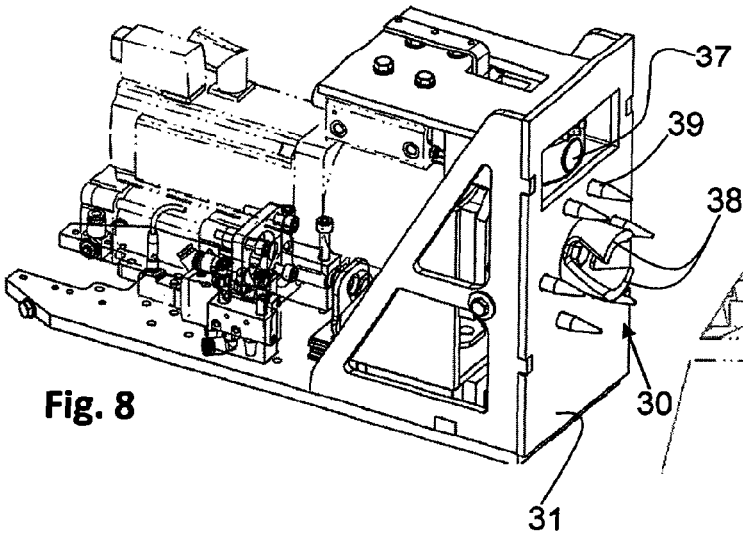
FIG. 8 shows a winding unit in a perspective view.

FIGS. 1-3 depict a device 1 according to the invention from different angles. The device is intended for cutting and removal of wires from bales and for this purpose, it comprises two cutting units 2 and two winding units 3. In the embodiment shown, the cutting units 2 are positioned on one side of a working location W and the winding units 3 are positioned on the other side. The working location W designates the location at which the bale is positioned when its wires are removed. The bale is transported to the working location W by means of a conveyor belt 6*a*. The working location comprises a sliding plate 4, and a turning tool 5, which are both vertically adjustable between a position, where they are not intended to come into contact with the bale, and a position where they reach up above the conveyor belts 6*a* and 6*b*. The sliding plate 4 is furthermore arranged separately from the turning tool 5 such that it may be raised to a position in contact with the bale without changing the vertical position of the turning tool.

The cutting units 2, which in FIGS. 1 and 2 are arranged to the left and in FIG. 3 are arranged on the upper side, are provided with a cutting tool 20 each (not shown in FIGS. 1-3) and a flat front portion 21 each, having a recess 22 for the cutting tool 20. Further, each cutting tool 20 has a servo-motor that drives the cutting tool 20. The two cutting tools are arranged on a movable carriage 24 that is movable towards and from the working location W by means of a motor (not shown) and a driving belt (not shown) Further, the cutting units 2 are movably arranged on the said carriage 24 such that they each may be independently moved sideways by means of a motor (not shown) and a driving belt (not shown).

The winding units 3 are positioned opposite of the cutting units 2 and are designed correspondingly. Accordingly, the winding units 3 each comprise a winding tool 30 (shown in FIGS. 8-11) and a plat front portion 31 having a recess 32 for the winding tool 30. Further, each winding tool 30 has a servo-motor that drives the tool 30. The two tools are arranged on a movable carriage 34 that is movable towards and from the working location W by means of a motor (not shown) and a driving belt (not shown). Further, the winding units 3 are movably arranged on the said carriage 34 such that they each may be independently moved sideways by means of a motor (not shown) and a driving belt (not shown). The carriage 34 for the winding units 3 may advantageously be coupled to the carriage 24 for the cutting units 2, whereby the motion of the carriages 24, 34 is coordinated such that the cutting units 2 and the winding units 3 are always located at the same distance from the centre of the working location W.

The first step in the process for wire removal involves bringing the bale to the working location W, in which its centre of gravity is intended to rest directly above the sliding plate 4. This is achieved by means of the first conveyor belt 6*a*, which drives the bale towards the working location W at the same time as the cutting units 2 and the winding units 3 are retracted in order not to disturb bringing in the bale to the working location W. When the bale has been brought in, such that it is positioned directly in front of the cutting units 2 and the winding units 3, it should however be adjusted such that its sides are completely aligned with the units 2 and 3. The bale normally has the form of a rectangular parallelepiped but is seldom shaped like a cube. It is usually provided with 1-4 wires. In the case where it is provided with four wires, these run pairwise around the bale in two directions, whereby the first pair is removed at a first position, after which the bale is rotated 90° such that the second pair may be removed.

The positioning of the bale is carried out by raising the sliding plate 4, after which the units 2 and 3 are being brought towards the bale. Since the weight of the bale is positioned directly above the sliding plate 4, the bale may be rotated freely with respect to the sliding plate without a risk of turning over. Consequently, the bale will automatically become positioned when the units 2 and 3 are brought in towards the bale. At this moment, the tools 20 and 30 of the units 2 and 3, respectively, are retracted such that the bale can only come into contact with the flat front portion 21 and 31 of the units 2 and 3, respectively, such that it can slide with respect to these and thereby straighten itself up to the desired position. Once the bale has been positioned, it is time to position the respective tools in front of the wires. This is achieved by means of sensors 27, 37 (shown in FIGS. 4-11) on the respective units and in the embodiment shown the sensors consist of inductive sensors. The wires are usually composed by ferromagnetic steel wires, which may be localised by means of such inductive sensors. The sensors are working while the units are being moved sideways along the bale, and the sensors will emit a signal when they detect a wire directly in front of the tools 20, 30.

After said positioning has been completed, the cutting and removing of wires may start. The tools are thus being brought out through the fronts 21, 31, respectively, in recesses 22, 32 designed for this purpose. When the tools are being brought out they are arranged in a gripping mode such that they catch the wires on each side of the bale. Next, the wire is cut off on one side of the bale, whereupon it is wound onto the wire removing tool on the opposite side of the bale. During this moment, the bale may advantageously still remain standing on top of the sliding plate 4, such that there is no risk of the wires getting caught between the bale and the conveyor belts as they are being wound onto the wire removing tool 30 and one end of the wire is being drawn under the bale. A further advantage of this is that the edges of the bale do not risk getting destroyed, which otherwise often happens as the wire is being drawn under the bale when resting on a flat base.

The next step constitutes rotating the bale such that the remaining two wires may be removed. This is done by retracting the cutting units 2 and the winding units 3, after which the turning tool 5 is being raised into contact with the bale. The turning tool 5 is formed as an antenna and provided with eight spikes that are designed to pin the bale in order to fix it to the turning tool. Subsequently, the turning tool 5 and the bale are turned 90°, at which the second pair of wires will face the tools such that they may be removed. After the said turning, the turning tool 5 is lowered while the sliding plate 4 stays in its raised position, such that the bale again rests on the sliding plate. Next, the units 2 and 3 are brought in towards the bale, and the steps described above are repeated for the remaining two wires.

In the following, the cutting units 2 and the winding units 3 will be described more in detail with reference to FIGS. 4-7 and FIGS. 8-11, respectively.

As described above and which is apparent from FIG. 4, the cutting unit 2 comprises a cutting tool 20 that protrudes through a recess 22 in a front portion 21. Further, a sensor 27 is arranged in a second recess 22*a* in the front portion. The cutting tool consists of two main parts, an outer fixed cutter 28 and an inner rotatable cutter 29.

In FIG. 5 it is shown how the inner cutter 29 is connected to a shaft 10 that is driven by a motor (not shown). The motor may be of any kind, e.g. electric, pneumatic, hydraulic or any other type that can deliver a torque to the shaft 10. The inner cutter 29 is rotatable about an axis A, which is intended to extend perpendicularly with respect to the wire 9 that is to be cut off. The fact that the cutter is driven by a rotating shaft constitutes one of the advantages of the invention. A common problem of conventional cutting devices is to convert the torque from the motor to an axial force, to thereby achieve a cutting motion. Since the cutting motion according to the invention is achieved directly by means of a rotating shaft 10, this problem is however easily and efficiently solved.

In FIGS. 6 and 7, the actual step of cutting is shown. First, the sensor 27 detects the position of the wire 9 with respect to the cutting unit 2, after which the cutting unit 2 is moved along the bale 8 such that the cutting tool is positioned in front of the wire 9. At this point, as the cutting unit 2 is moved sideways with respect to the working location W, the cutting unit is somewhat retracted with respect to the bale, such that a space of approximately 30 mm exists between the front portion 21 and the bale 8. However, at the same time the sensor protrudes approximately 30 mm through the recess 22*a* to be in contact with the side of the bale and thereby to be able to localise the wire. Only after the localisation step is completed the cutting tool 20 is brought out through the recess 2, having the cutters 28 and 29 placed in the starting position on one side each of the wire 9, being ready to cut. The cutting edges of the cutters 28, 29 extend axially along the axis A in the continuation of the cutting tool to cut off objects that are located in the continuation of the cutting tool along the axis A. The cutting step should however be synchronised with the step of wire removal, which is described in detail below, which means that the cutting should not be carried out before the winding unit 3 on the opposite side is positioned to wind the wire.

The cutting is achieved by rotating the shaft 10 clockwise such that the cutting edge of the inner cutter 29 catches the wire 9 and brings the said wire towards the cutting edge of the outer cutter 28, and the wire is cut off when the cutting edges of the cutters pass each other. The cutting edges of the cutters are slightly inclined inwards to catch the wire 9 more easily and thereby prevent the wire from sliding out from between the cutters. After the cutting is completed, the cutters of the cutting tool may be brought back to the starting position and the entire tool may advantageously also be retracted through the recess 22 in order to be protected by the front portion 21.

Figure 9:
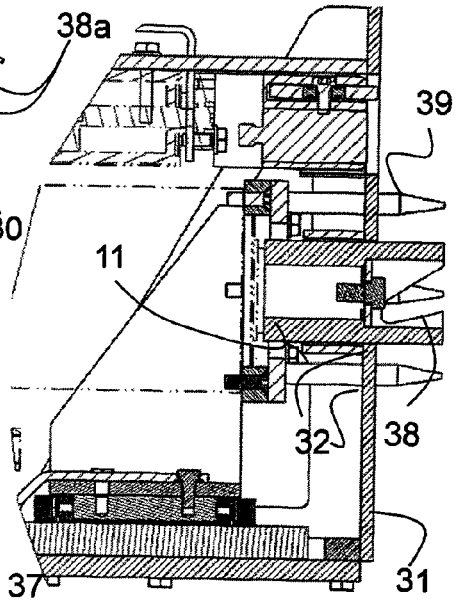
FIG. 9 shows the winding unit in FIG. 8 partly in cross-section.
Figure 10:
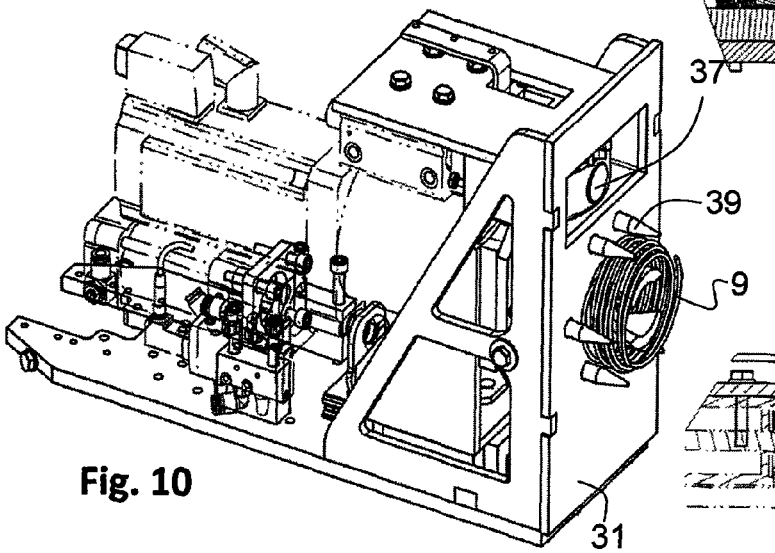
FIG. 10 shows the winding unit in a perspective view with a wound-up wire.
Figure 11:
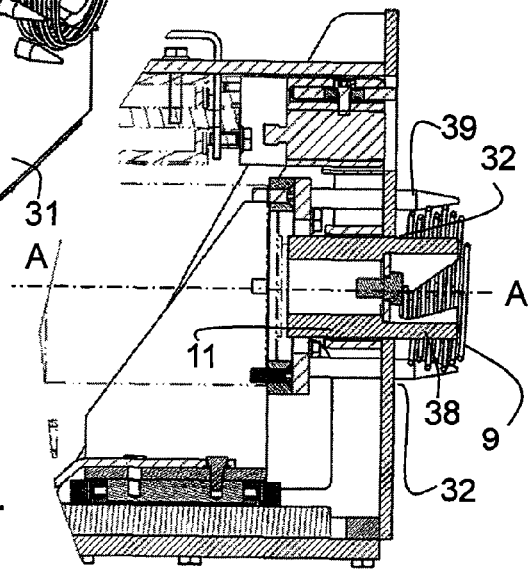
FIG. 11 shows the winding unit in FIG. 10 partly in cross-section.

FIGS. 8-11 show the winding unit 3, which mainly consists of a sensor 37, a front portion 31 and a tool 30 that may be brought in and out of a recess 32 in the front portion. The tool consists of two main parts, a reel 38 for winding of the wire and six pins 39 that are intended to limit the radial extension of the coil of the wire 9. The reel 38 comprises two opposite tongues 38*a*, which delimit two skewed recesses for picking up the wire. In FIG. 9 it is shown how the reel 38 is connected to a shaft 11, which is driven by a motor in the same way as the cutting tool 20 of the cutting unit 2.

It is very advantageous that the cutting units 2 and the winding units 3 are constructed in the same way. The only constructional difference between the respective units is the tools 20 and 30 and the form of the recesses, i.e. how the recesses are formed on the respective front 21 and 31. As to the rest, the units may be identical, which of course yields large profits, both as a result of lower production costs and thanks to less complicated maintenance due to fewer different components.

The two kinds of units are also functionally very similar. Thus, to localise the wire and position the winding unit 3 correctly with respect to the wire 9, the sensor 37 is utilised. After the winding unit 3 has been positioned in front of the wire 9, the winding tool 30 is brought out through the recess 32 in the front portion 31. As the tool is brought out, the tongues 38*a* of the reel 38 are preferably positioned to the sides such that a vertical opening is formed between them, in which the wire 9 may be picked up. As the wire is then cut off on the opposite side of the bale, the winding may be started immediately. Consequently, there is suitably some kind of steering device that correlates the performance of the winding unit to the performance of the cutting unit.

The winding of the wire from the bale is carried out by letting the reel rotate counter clockwise to make use of the skew setting of the tongues and to grab the wire between them until the whole wire is wound onto the reel. Once the wire is wound up to the extent shown in FIGS. 10 and 11, the tool may again be retracted into the front portion, and the wound-up pulley of wire may be dropped into a collection device (not shown) placed under the winding unit 3.

The invention has been described with reference to an exemplifying embodiment. To a person skilled in the art it is however obvious that the invention may be designed in a large number of ways without departing from the inventive thought or its scope of protection, which is only limited by the enclosed claims.

While the present invention has been described in accordance with preferred compositions and embodiments, it is to be understood that certain substitutions and alterations may be made thereto without departing from the spirit and scope of the following claims.

The invention claimed is:

1. A cutting unit in an arrangement for cutting and removing wires from bales, comprising:

a cutting tool, adapted to cut off wires that are arranged around a bale, having an outer cutter and an inner cutter which are coaxially arranged and the inner cutter being rotatable relative to the outer cutter, and the inner cutter having a cutting edge movable towards the outer cutter when the inner cutter is rotated towards the outer cutter in a predetermined direction, in order to cut off objects between the outer cutter and the inner cutter, the inner cutter being rotatable about an axis (A) extending perpendicularly with respect to a wire that is to be cut off, the cutting edges of the inner cutter and the outer cutter extending axially along the axis (A) in a continuation of the cutting tool to cut off objects that are located in the continuation of the cutting tool along the axis (A), a flat front portion which is arranged to face a working location (W) at which the bale is to be positioned when wires of the bale are cut off and removed from the bale, and the flat front portion has a recess defined therein through which the cutting tool is arranged to be carried back and forth between a retracted position and a working position, when in the retracted position the cutting tool is positioned behind the front portion, and when in the working position the cutting tool protrudes through the front portion.

2. The cutting unit according to claim 1 wherein a sensor is arranged to localize the wire on the bale, a driving device is arranged to move the cutting unit along the working location (W) such that the cutting tool is placed directly in front of the wire that is to be cut off.

* * * * *